US005215958A

United States Patent [19]

Neumann et al.

[11] Patent Number: 5,215,958

[45] Date of Patent: Jun. 1, 1993

[54] DYE-DONOR BINDER FOR LASER-INDUCED THERMAL DYE TRANSFER

[75] Inventors: Stephen M. Neumann, Rochester; Daniel J. Harrison, Pittsford, both of N.Y.

[73] Assignee: Eastman Kodak Company, Rochester, N.Y.

[21] Appl. No.: 918,186

[22] Filed: Jul. 23, 1992

[51] Int. Cl.[5] ..... B41M 5/035; B41M 5/38

[52] U.S. Cl. ..... 503/227; 428/195; 428/328; 428/913; 428/914; 430/200; 430/201; 430/945

[58] Field of Search ..... 8/471; 428/195, 328, 428/913, 914; 430/200, 201, 945; 503/227

[56] References Cited

U.S. PATENT DOCUMENTS 5,017,547 5/1991 DeBoer ..... 503/227

*Primary Examiner*—B. Hamilton Hess

*Attorney, Agent, or Firm*—Harold E. Cole

[57] ABSTRACT

This invention relates to a dye donor element for laser-induced thermal dye transfer comprising a support having thereon a dye layer comprising an image dye in a binder and an infrared absorbing material associated therewith, and wherein said binder comprises an inorganic colloid, such as colloidal titanium dioxide or colloidal silicon dioxide.

15 Claims, No Drawings

DYE-DONOR BINDER FOR LASER-INDUCED THERMAL DYE TRANSFER

This invention relates to the use of an inorganic colloid material as a binder in the donor element of a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

A laser imaging system typically involves a donor element comprising a dye layer containing an infrared absorbing material, such as an infrared absorbing dye, and one or more image dyes in a binder.

In U.S. Pat. No. 5,017,547, there is a disclosure of typical binders for laser-induced thermal dye transfer systems. These binders are polymeric materials with cellulose acetate propionate being preferred. During the thermal dye transfer process, the viscoelastic properties of this binder play a role in the mechanism by which dye is transferred from the donor element to the receiver as a function of laser power. As a result, the tone scale is not as good as one would desire. Any improvement in tone scale due to a change in the binder would be desirable.

It is an object of this invention to provide a way to improve the tone scale in a laser-induced thermal dye transfer system.

These and other objects are achieved in accordance with this invention which relates to a dye donor element for laser-induced thermal dye transfer comprising a support having thereon a dye layer comprising an image dye in a binder and an infrared absorbing material associated therewith, and wherein said binder comprises an inorganic colloid.

By use of this invention, the inorganic colloid system forms a three-dimensional network which is resistant to viscoelastic motions such as distortions or flow. It is believed that this structure enables one to achieve better tone scale.

Any inorganic colloid may be used as the binder in the invention such as colloidal titanium dioxide, colloidal silicon dioxide, colloidal aluminum dioxide or colloidal zirconium dioxide. In a preferred embodiment of the invention, the inorganic colloid is colloidal silicon dioxide, commercially available as Ludox AM® (DuPont Company) or Aerosil R972® (Degussa Company), or colloidal titanium dioxide, commercially available as P25® (Degussa Company). The binder may be used at a coverage of from about 0.1 to about 5 g/m2

In another preferred embodiment of the invention, the infrared absorbing material is a dye which is located in the dye layer.

To obtain the laser-induced thermal dye transfer image employed in the invention, a diode laser is preferably employed since it offers substantial advantages in terms of its small size, low cost, stability, reliability, ruggedness, and ease of modulation. In practice, before any laser can be used to heat a dye-donor element, the element must contain an infrared absorbing material, such as carbon black or cyanine infrared absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a internal conversion. Thus, the construction of a useful dye layer will depend not only on the hue, transferability and intensity of the image dyes, but also on the ability of the dye layer to absorb the radiation and convert it to heat. The infrared absorbing dye may be contained in the dye layer itself or in a separate layer associated therewith.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses a laser as described above to form an image on a thermal print medium is described and claimed in copending U.S. application Ser. No. 451,656 of Baek and DeBoer, filed Dec. 18, 1989, the disclosure of which is hereby incorporated by reference.

Any dye can be used in the dye-donor employed in the invention provided it is transferable to the dye-receiving layer by the action of the laser. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

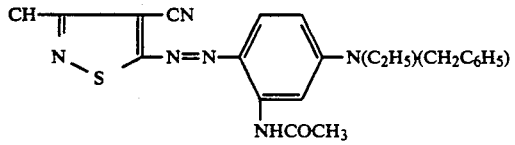

(magenta)

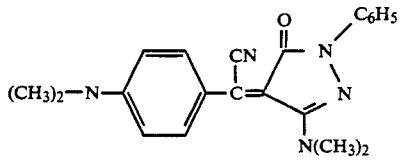

(magenta)

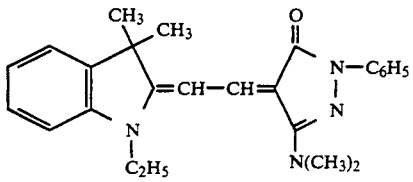

(yellow)

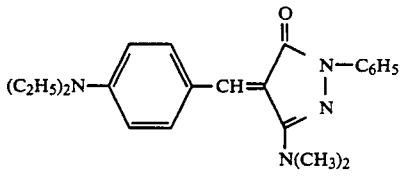

(yellow)

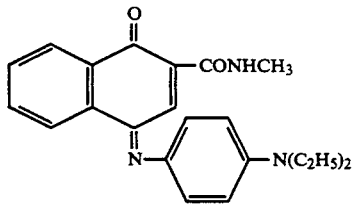

(cyan)

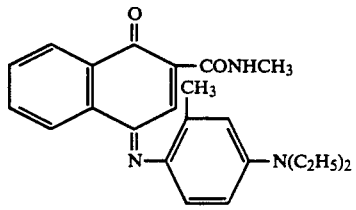

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye layer of the dye-donor element may be coated on the support or printed thereon by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as polyvinylidene fluoride or poly(tetrafluoroethylene-cohexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486. The dye-receiving element that is used with the dye-donor element employed in the invention usually comprises a support having thereon a dye imagereceiving layer or may comprise a support made out of dye image-receiving material itself. The support may be glass or a transparent film such as a poly(ether sulfone), a polyimide, a cellulose ester such as cellulose acetate, a poly(vinyl alcohol-co-acetal) or a poly(ethylene terephthalate). The support for the dyereceiving element may also be reflective such as baryta-coated paper, white polyester (polyester with white pigment incorporated therein), an ivory paper, a condenser paper or a synthetic paper such as duPont Tyvek®. In a preferred embodiment, an injection-molded polycarbonate support is employed.

The dye image-receiving layer may comprise, for example, a polycarbonate, a polyester, cellulose esters, poly(styrene-co-acrylonitrile), poly(caprolactone) or mixtures thereof. The dye imagereceiving layer may be present in any amount which is effective for the intended purpose. In general, good results have been obtained at a concentration of from about 1 to about 5 g/m$^2$.

A process of forming a laser-induced thermal dye transfer image according to the invention comprises:

a) contacting at least one dye-donor element comprising a support having thereon a dye layer in a binder as described above having an infrared absorbing material associated therewith, with a dye-receiving element comprising a support having thereon a polymeric dye image-receiving layer;

b) imagewise-heating the dye-doner element by means of a laser; and c) transferring a dye image to the dye-receiving element to form the laser-induced thermal dye transfer image.

The following example is provided to illustrate the invention.

EXAMPLE

A dye-doner element was prepared by coating the following dye layer on a 100 μm unsubbed poly(ethylene terephthalate) support: a cyan dye layer of the two cyan dyes illustrated above (each at 0.39 g/m$^2$), the cyanine infrared absorbing dye illustrated below (0.13 g/m²), FC-431 ® fluorocarbon surfactant (3M Company) (0.011 g/m²), and the inorganic colloid binder identified in the Table (0.54 g/m²) coated from a dichloromethane and 1,1,2-trichloroethane solvent mixture.

A control dye-donor element was prepared as described above except that the binder was cellulose acetate propionate (2.5% acetyl, 46% propionyl) 0.39 g/m²).

Each of the above dye-donor elements was overcoated with a spacer layer of crosslinked poly(styrene-co-divinyl-benzene) beads (90:10 ratio) (8 μ average particle diameter) (0.047 g/m²) and 10G surfactant (a reaction product of nonylphenol and glycidol) (Olin Corp.) (0.006 g/m²) in a binder of Woodlok ®40-0212 white glue (a water based emulsion polymer of vinyl acetate) (National Starch Co.) (0.047 g/m²).

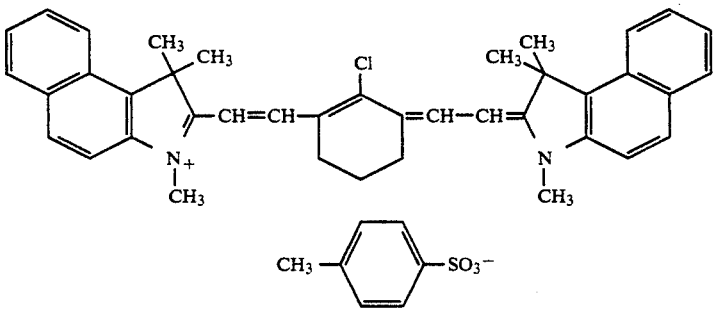

Cyanine Infrared Absorbing Dye

Dye-receiving elements were prepared from flate samples (1.5 mm thick) of Ektar ® DA003 (Eastman Kodak), a mixture of bisphenol A polycarbonate and poly (1,4-cyclohexylene dimethylene terephthalate) (50:50 mole ratio).

Cyan dye images were produced as described below by printing the cyan dye-donor sheets onto the dye receiver using a laser imaging device similar to the one described in U.S. Ser. No. 457,595 of Sarraf et al, filed Dec. 27, 1989, entitled "Thermal Slide Laser Printer". The laser imaging device consisted of a single diode laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a lens which focused the beam onto a flat platen equipped with vacuum grooves. The platen was attached to a moveable stage whose position was controlled by a lead screw which determined the y axis position of the image. The dye-receiver was held tightly to the platen by means of the vacuum grooves, and each dye-donor element was held tightly to the dye-receiver by a second vacuum groove.

The laser beam had a wavelength of 830 nm and a power output of 37 mWatts at the platen. The measured spot size of the laser beam was an oval of nominally 7 by 9 microns (with the long dimension in the direction of the laser beam sweep). The center-to-center line distance was 10 microns (2941 lines per inch) with a laser scanning speed of 26.9 Hz.

Twenty-five laser power levels (i.e. 25 resulting density transfers) were examined for each donor. The laser power was varied from a maximum at full power over 25 decrements, each by 3.125%, of full power to a minimum of 25% of full power. The density data were plotted as a function of laser power and analyzed for average and maximum density changes versus power change. The average slope of the density versus power relationship was taken to be the slope of the linear fit of the data at laser powers above those required to transfer dye (i.e., above the threshold level). The maximum slope was arrived at by pairwise inspection of the data to determine which pair points had maximum to average slope would be equal to 1, signifying a smooth density change versus laser power. To the degree that the ratio exceeds the value of 1, a discontinuity in transfer density has occurred. The larger the value of the ratio, the greater (and less desirable) the discontinuity. Data for the above analysis are shown in Table 1.

TABLE 1

| BINDER | AVG. SLOPE | MAX. SLOPE | RATIO OF AVG./MAX |
|---|---|---|---|
| Colloidal $TiO_2$ | 8.05 | 12.50 | 1.55 |
| Ludox AM ® colloidal silica | 6.74 | 15.00 | 2.23 |
| Aerosil R972 ® colloidal silica | 9.44 | 23.75 | 2.51 |
| Cellulose Acetate Propionate (control) | 8.12 | 28.75 | 3.54 |

The effectiveness of using an inorganic, colloidal binder instead of the conventional polymeric binder appears to be evident.

The invention has been described in detail with particular reference to preferred embodiments thereof, but it will be understood that variations and modifications can be effected within the spirit and scope of the invention.

WHAT IS CLAIMED IS:

1. In a dye donor element for laser-induced thermal dye transfer comprising a support having thereon a dye layer comprising an image dye in a binder and an infrared absorbing material associated therewith, the improvement wherein said binder comprises an inorganic colloid.

2. The element of claim 1 wherein said inorganic colloid is colloidal titanium dioxide.

3. The element of claim 2 wherein said inorganic colloid is colloidal silicon dioxide.

4. The element of claim 1 wherein said infrared absorbing material is in said dye layer.

5. The element of claim 1 wherein said infrared absorbing material is a dye.

6. In a process of forming a laser-induced thermal dye transfer image comprising:

a) contacting at least one dye-donor element comprising a support having thereon a dye layer in a binder having an infrared-absorbing material associated therewith, with a dye-receiving element comprising a support having thereon a poiymeric dye image-receiving layer;

b) imagewise-heating said dye-donor element by means of a laser; and c) transferring a dye image to said dye-receiving element to form said laser-induced thermal dye transfer image, the improvement wherein said binder comprises an inorganic colloid.

7. The process of claim 6 wherein said inorganic colloid is colloidal titanium dioxide.

8. The process of claim 6 wherein said inorganic colloid is colloidal silicon dioxide.

9. The process of claim 6 wherein said infrared absorbing material is in said dye layer.

10. The process of claim 6 wherein said infrared absorbing material is a dye.

11. In a thermal dye transfer assemblage comprising:

(a) a dye donor element comprising a support having thereon a dye layer comprising a dye dispersed in a binder having an infrared absorbing material associated therewith, and (b) a dye-receiving element comprising a support having thereon a dye image-receiving layer, said dye-receiving element being in superposed relationship with said dye-donor element so that said dye layer is in contact with said dye image-receiving layer, the improvement wherein said binder comprises an inorganic colloid.

12. The assemblage of claim 11 wherein said inorganic colloid is colloidal titanium dioxide.

13. The assemblage of claim 11 wherein said inorganic colloid is colloidal silicon dioxide.

14. The assemblage of claim 11 wherein said infrared absorbing material is in said dye layer.

15. The assemblage of claim 11 wherein said infrared absorbing material is a dye.

* * * * *